United States Patent [19]

Hiraoka et al.

[11] 3,930,902

[45] Jan. 6, 1976

[54] RELATIVE SLIDING MEMBERS

[75] Inventors: Takeshi Hiraoka, Ageo; Shigeru Urano, Ohmiya, both of Japan

[73] Assignee: Nippon Piston Ring Co., Ltd., Tokyo, Japan

[22] Filed: Jan. 31, 1975

[21] Appl. No.: 546,172

[30] Foreign Application Priority Data

Jan. 31, 1974 Japan ..... 49-13340

[52] U.S. Cl. ..... 148/31.5; 29/196.1; 75/123 CB; 148/34

[51] Int. Cl.[2] ..... C22C 38/16

[58] Field of Search ..... 75/123 R, 123 J, 123 CB; 29/195, 196.1, 182.3, 182.5; 148/31.5, 34

[56] References Cited

UNITED STATES PATENTS 3,793,691 2/1974 Takahashi et al. ..... 29/182

*Primary Examiner*—L. Dewayne Rutledge
*Assistant Examiner*—E. L. Weise
*Attorney, Agent, or Firm*—Sughrue, Rothwell, Mion, Zinn & Macpeak

[57] ABSTRACT

Relative sliding members comprising as materials in combination a nitrified sintered alloy and an alloy cast iron, chemical components of which are well selected in percentage so as to provide better wear resistance and machinability.

1 Claim, No Drawings

RELATIVE SLIDING MEMBERS

BACKGROUND OF THE INVENTION

1. Field of the Invention

This invention relates to a relative sliding member such as rotary compressors, by which wear resistance is required.

2. Description of the Prior Art

As a material used for vanes and rollers, which constitute a most important part of compressors, steel, cast iron, sintered material or the like have heretofore been used. These materials, however, are poor in wear resistance, machinability or the like, thus posing problems still remained to be solved.

DESCRIPTION OF THE INVENTION

The present invention overcomes the disadvantages as noted above.

According to the present invention there are provided relative sliding members comprising a nitrified sintered alloy, as a material for the vane, consisting of by weight, 0.90–2.00 % of T.C, 2.00–6.00 % of Cu, 0.40–0.80 % of Mo, and less than 1.00 % of other elements, the balance iron, and an alloy cast iron, as a material for the roller, consisting of by weight, 2.00–3.50 % of carbon, 1.50–2.50 % of silicon, 0.30–1.00 % of manganese, less than 0.30 % of phosphorus, less than 0.12 % of sulfur, 0.20–1.00 % of copper, 0.20–1.00 % of molybdenum, and the balance iron, said sintered alloy being relatively combined with said member and alloy cast iron.

The reasons for limiting components of the material for the vane used in the present invention will be hereinafter described. The quantity of total carbon is defined by weight from 0.90 to 2.00 % due to the fact that when it is less than 0.90 %, a close pearlite to maintain the wear resistance may not be obtained, while when it is more than 2.00 %, a cementite increases in quantity to extremely develop fragility and is impractical. The copper is added so as to improve corrosion resistance and to improve thermal conductivity and is defined from 2.00 to 6.00 % due to the fact that when it is less than 2 %, the properties required for the material in the present invention may not be satisfactorily obtained, while when it is more than 6 %, the sintered material would lose the stability in its dimension. The molybdenum is added in the form of a ferromolybdenum, whose hard particles may extremely improve the wear resistance, and the value of upper limit thereof is determined as previously stated due to the fact that when it is less than 0.40 %, the distinguished effect may not be attained, while when it is more than 0.80 %, the strength of the sintered material tends to be decreased. The 1 % of other remainder is to be contained from the additives or the like with the manufacture of the sintered material.

The method of applying gas nitrification to the sintered alloy having the above-described components may be carried out by nitrification within a furnace under the gas atmosphere. It is noted that the depth of the nitride layer is preferably of the order of approximately 1 mm. In this case, the hardness increases by about HRC 30–50, greatly contributing to the wear resistance.

The reasons for limiting components of the material for the roller, the mating member, will now be described. The carbon is defined from 2.0 to 3.50 % due to the fact that when it is less than 2.00 %, an A-type flake graphite (ASTM Standard) may not be obtained, while when it is more than 3.50 %, the graphite may be magnified. The silicon is defined from 1.50 to 2.50 % due to the fact that when it is less than 1.50 %, the flake graphite may not be formed as in the case of carbon, while when it is more than 2.50 %, the fragility of the material will result. The manganese in excess of 0.30 % would be required to stabilize the pearlite, but the manganese in excess of 1.00 % is not required for the purpose thereof. The copper is also contained so as to stabilize the pearlite, and the manganese less than 0.20 % is less effective, but more than 1.00 % thereof is not required. The molybdenum serves not only to strengthen the base but also to improve hardenability, and is defined from 0.20 to 1.00 % due to the fact that when it is less than 0.20 %, the distinguished effect may not be attained, while when it is more than 1.00 %, it may possibly be formed into bainite in terms of content of copper.

In a cast condition, the alloy cast iron as described is the pearlite base where the A-type graphite is distributed and has its better machinability. Further, this material may be hardened and tempered to form the base into martensite and to have the hardness from HRC 43 to 53, thus highly improving the wear resistance.

For a better understanding of the present invention, examples thereof may be described in the following.

As a material for vane, copper powder, ferromolybdenum powder, and graphite powder are combined, to which 0.8 % of zinc stearate is added, after which they are sintered at 1,150°C for 60 minutes under the cracked ammonia gas atomosphere to obtain an iron system sintered alloy comprising 1.20 % of T.C, 4.00 % of Cu, 0.60 % of Mo, and the balance iron. At this time, the hardness was HRB 88.5, and the density was 6.75 g/cm$^3$. Such material is further nitrified within a furnace under the gas atmosphere to obtain a layer of compound 1 mm in depth. The hardness was then 38–40 in HRC.

On the other hand, as a material for roller, 3.22 % of T.C, 0.44 % of Mo, 2.10 % of Si, 0.52 % of Mn, 0.40 % of Cu, and the balance Fe are combined, and the resultant material was hardened at 860°C for 60 minutes and then oil-cooled, after which it was tempered in open air at 320°C for 60 minutes. The hardness was then HRC 47.0.

Thereafter, from a respective one of the above-discribed material, a test-piece having an outside diameter 40 $\phi$, inside diameter 16 $\phi$, and thickness 10 mm is formed. This test-piece was subjected to the confirmation test of the wear resistance under the conditions as noted below using an Amsler type wear resistance testing machine with the material corresponding to the vane material as an upper fixed member while with the material corresponding to the roller material as a lower rotating member.

| Testing Conditions | |
|---|---|
| Speed of rotation | 185 rpm |
| Load | 100 kg |
| Lubricating oil | Kerosene 60 % + oil SAE No. 3 40 % |
| Quantity of oil | 0.5 lit./min. |
| Running time | 24 hours |

Further, for comparing with the relative sliding member according to the present invention, the test was conducted under the same conditions as that of the above with the use of the prior art combination wherein the roller comprised of eutectic graphite cast iron and the vane comprised of steel are relatively combined. The chemical components of the eutectic graphite cast iron and the steel are as follows:

1. Eutectic graphite cast iron
   Chemical Component (%)

| T.C | Si | Mn | Ni | Cr | Mo |
|---|---|---|---|---|---|
| 2.71 | 3.52 | 0.50 | 0.09 | 0.12 | 0.11 |

2. Steel SUP 9 (JIS)

According to the test, the result showed that in the combination of the present invention, the wear is 2.0 mmg in the case of the vane material and 5.0 mmg in the case of the roller material, with the running time of 24 hours, while in the combination of the prior art, both the vane material and the roller material are resulted in scuffing soon after the run, resulting in an impossibility of operation.

From the foregoing, it will be understood that the relative sliding member in accordance with the present invention may provide an eminent wear proof. The member of the invention further provides eminent grindability and workability since one of members utilizes a sintered material.

What is claimed is:

1. Relative sliding members in mating combination comprising a nitrified sintered alloy consisting of by weight 0.9–2.00% of T.C, 2.00–6.00% of Cu, 0.40–0.80% of Mo, less than 1.00% and other elements, and the balance iron, and an alloy cast iron consisting of by weight 2.00–3.50% of carbon, 1.50–2.50% of silicon, 0.03–1.00% of manganese, less than 0.30% of phosphorous, less than 0.12% of sulfur, 0.20–1.00% of copper, 0.2–1.00% of molybdenum, and the balance iron.

* * * * *